US005850785A

United States Patent [19]

Vallius

[11] Patent Number: 5,850,785

[45] Date of Patent: Dec. 22, 1998

[54] COUPLING CONSTRUCTION BETWEEN AN EXTENDED-NIP ROLL AND A BACKUP ROLL

[75] Inventor: Oiva Vallius, Jyväskylä, Finland

[73] Assignee: Valmet Corporation, Helsinki, Finland

[21] Appl. No.: 840,137

[22] Filed: Apr. 11, 1997

[30] Foreign Application Priority Data

Jun. 5, 1996 [FI] Finland ..... 962336

[51] Int. Cl.[6] ..... D21G 1/00; B30B 3/04

[52] U.S. Cl. ..... 100/35; 72/238; 72/245; 100/153; 100/170; 162/272; 162/358.3

[58] Field of Search ..... 100/35, 153, 155 R, 100/160, 168–169, 170, 176; 72/237, 238, 241.6, 245; 162/272, 273, 358.3, 360.2

[56] References Cited

U.S. PATENT DOCUMENTS

| | | | |
|---|---|---|---|
| 2,157,455 | 5/1939 | Kimmel . | |
| 3,130,628 | 4/1964 | Blinn | 100/170 |
| 3,286,501 | 11/1966 | Tracy | 72/237 |
| 3,516,276 | 6/1970 | Bond | 72/237 |
| 3,921,514 | 11/1975 | Biondetti . | |
| 4,095,448 | 6/1978 | Gipperich | 72/245 |
| 4,156,453 | 5/1979 | Scheinecker . | |
| 4,790,908 | 12/1988 | Roerig et al. . | |
| 4,791,863 | 12/1988 | Vahatalo . | |
| 4,920,778 | 5/1990 | Swagr et al. | 72/245 |
| 5,291,826 | 3/1994 | Schiel . | |
| 5,385,088 | 1/1995 | Grabscheid . | |
| 5,400,708 | 3/1995 | Meschenmoser . | |
| 5,404,811 | 4/1995 | Schiel et al. . | |
| 5,507,223 | 4/1996 | Vallius . | |
| 5,547,547 | 8/1996 | Bengtsson . | |
| 5,590,593 | 1/1997 | Korhonen et al. . | |

FOREIGN PATENT DOCUMENTS

| | | | |
|---|---|---|---|
| 0442257 | 8/1991 | European Pat. Off. . | |
| 57653 | 8/1974 | Finland . | |
| 76872 | 8/1988 | Finland . | |
| 933520 | 2/1995 | Finland . | |
| 94651 | 6/1995 | Finland . | |
| 95062 | 6/1995 | Finland . | |
| 950580 | 12/1995 | Finland . | |
| 4231472 | 4/1993 | Germany | 100/176 |
| 624265 | 8/1961 | Italy | 100/170 |
| 845160 | 8/1960 | United Kingdom | 100/168 |
| 9217641 | 10/1992 | WIPO . | |

*Primary Examiner*—Stephen F. Gerrity
*Attorney, Agent, or Firm*—Steinberg & Raskin., P.C.

[57] ABSTRACT

A coupling construction between an extended-nip roll including a non-revolving central axle supported by bearings which permit angular deflection of the non-revolving axle and a backup roll. Loading members are mounted on the non-revolving axle for pressing a loading shoe toward the backup roll. The extended-nip roll includes a flexible glide-belt mantle whereby a paper web or board web passes through the nip between the glide-belt mantle and the backup roll. The belt mantle revolves on support of separate bearings. The extended-nip roll and backup roll are interconnected from the bearing housings at the ends of the rolls by tie bolts which include a nut at one end which is threaded onto the threading at the end of the tie bolt. The tie bolt is associated with pre-tightening equipment at the other end of the tie bolt and is passed through bolt holes provided in the bearing housings to be coupled together. The other end of the tie bolt has the threading with which the pre-tightening equipment is coupled.

20 Claims, 9 Drawing Sheets

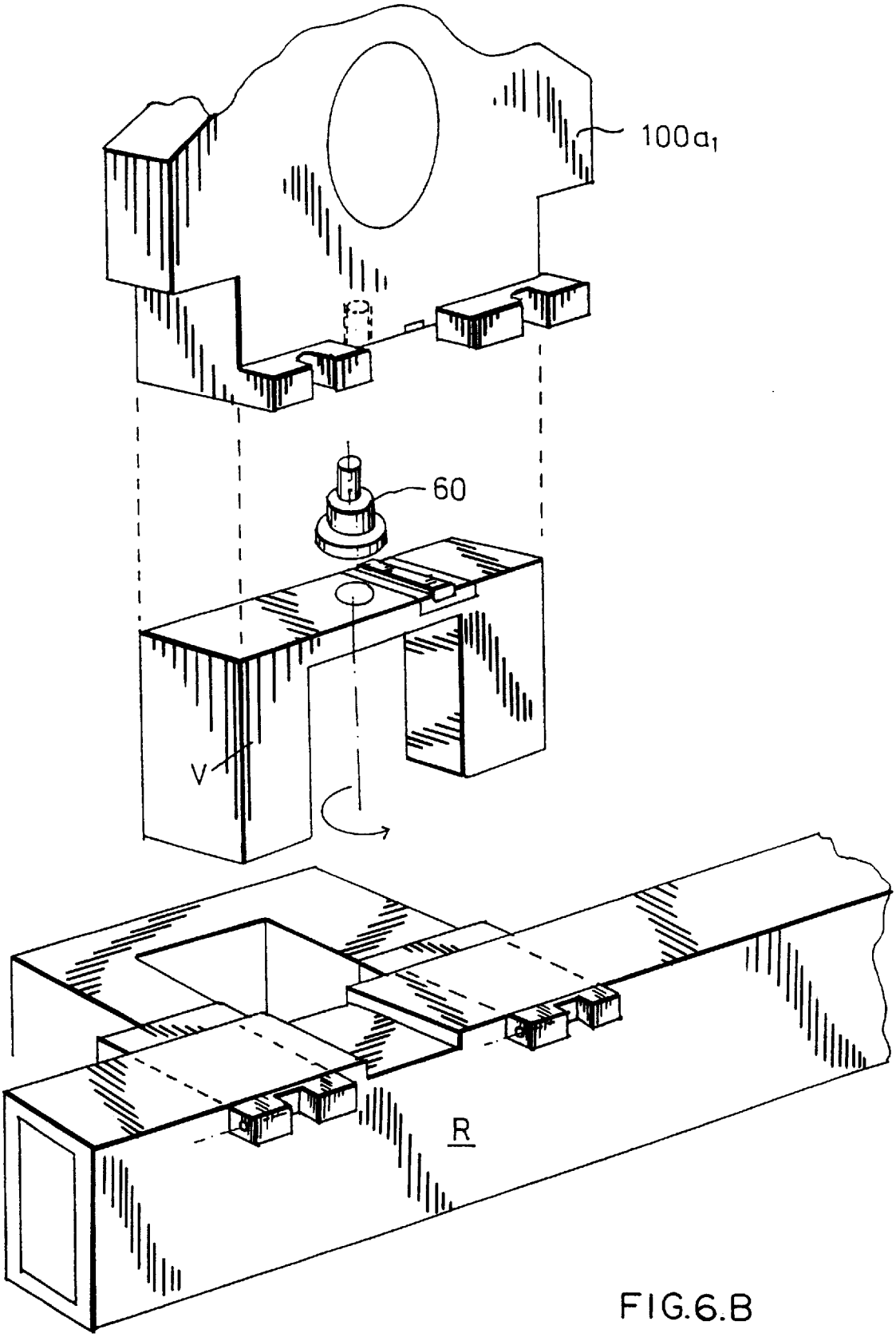
FIG.6.B

COUPLING CONSTRUCTION BETWEEN AN EXTENDED-NIP ROLL AND A BACKUP ROLL

FIELD OF THE INVENTION

The present invention relates to a coupling construction between an extended-nip roll and its backup roll. The present invention also relates to a method for interconnecting a pair of nip-defining rolls, in particular an extended nip roll and a back-up roll.

BACKGROUND OF THE INVENTION

In an extended-nip press used in a paper machine, relatively high nip loads occur. This imposes high requirements on the roll constructions, and in particular on the structural components through which the forces arising from nip loading are transferred.

The nip between extended-nip press rolls is composed, for example, of a pair of a SYM-ZL roll and a SYM-BELT roll. The linear load is at the maximum up to about 1200 kN per meter. In such a case, a normal screw link between the bearing housings of the pair of rolls is not possible because in order to overcome the linear load, up to about 130 screws would be required to link the rolls together by their bearing housings.

OBJECTS AND SUMMARY OF THE INVENTION

It is an object of present invention to provide a new and improved apparatus for interconnecting a pair of nip-defining press rolls, in particular an extended-nip roll and a back-up roll in nip-defining relationship with the extended-nip roll to define an extended nip.

It is another object of present invention to provide a new and improved method for interconnecting a pair of nip-defining press rolls, in particular an extended-nip roll and a back-up roll in nip-defining relationship with the extended-nip roll to define an extended nip.

In order to achieve these objects and others, in the apparatus in accordance with the invention for joining together the press rolls in an extended-nip press, and more particularly, joining together the bearing housings of the press rolls in an extended-nip press, strongly pre-tightened tie parts are utilized. The tie parts are connected with the bearing housing constructions so that they are protected from corrosion and the removal of the bearing housings can be carried out quickly when desired or necessary, e.g., in order to replace a belt mantle.

In one embodiment of the apparatus, the tie part, which is also referred to as a tie bolt, comprises a press ring or press part by whose means the tie part can be pre-tightened while the hydraulic pressure can be passed into the fluid space provided in connection with the press ring.

Further, separate screws are used in the coupling between the rolls in the extended-nip press. The screws can be subjected to a pre-tightening whose magnitude is at least about 20% higher than the maximal wire pressure. Preferably, at each end of the rolls, four studs or tie parts are used. The draw tightness of the screws is formed by means of a hydraulic device, whose pressure corresponds to the desired tightness.

When long screws, tie bolts, are used, it is possible to provide an elastically acting joint.

In one embodiment of the invention, the extended-nip roll is supported at each end by a first bearing housing, the backup roll is supported at each end by a second bearing housing, and each first bearing housing is connected by connecting means to a respective second bearing housing. In accordance with the invention, each first bearing housing has a plurality of bolt holes, each second bearing housing has a plurality of bolt holes, each of which aligns with a respective bolt hole in the first bearing housings, and the connecting means comprising a plurality of elongate tie bolts, each having first and second threaded ends and extending through a bolt hole in the first bearing housings and a respective aligned bolt hole in the second bearing housings, a nut threaded onto the first threaded end of each tie bolt for fixing the first threaded end of the tie bolts relative to the first and second bearing housings, and pre-tightening means arranged in connection with the second threaded end of each tie bolt for stretching the tie bolts. In use, the tie bolts are generally stretched by the pre-tightening means prior to rotation of the extended-nip roll and the backup roll, i.e., operation of the extended nip during which forces arise, and thus prior to the generation of nip loading forces. The first threaded end of each tie bolt may extend within the first bearing housings such that the nuts fix the tie bolts to the first bearing housings. The first bearing housings may define cavities to which the bolt holes in the first bearing housings extend whereby the first threaded end of each tie bolt extends into a cavity in the first bearing housings such that the nuts fix the tie bolt to the first bearing housings. The bolt holes in the second bearing housings may extend from a first face of the second bearing housings adjacent the respective one of the first bearing housings to a second face opposite to the first face whereby the second threaded end of the tie bolts extend beyond the second face such that the pre-tightening means are arranged in connection with the second face.

In certain embodiments, the pre-tightening means comprise a press part freely movable around the tie bolt and having an upper face and an annular groove opening from the upper face, a backup part threadably connected to the second threaded end of the tie bolt and having an annular shoulder engageable with the annular groove, and pressurizing means for pressurizing the annular groove to force the backup part and thus the second threaded end of the tie bolt in a direction away from the first threaded end of the tie bolt. The pressurizing means comprise a fluid duct connected to the press part for enabling passage of a pressurized fluid through the fluid duct into the annular shoulder and then into the annular groove. Locking means may be arranged in connection with an outer threaded surface of the backup part for locking the press part after pressurization of the annular groove to thereby lock the tie bolt in a pre-tightened condition. Such locking means include a lock ring which is threaded after pre-tightening of the tie bolt against the upper face of the press part.

In the method for coupling an extended-nip roll and a backup roll in accordance with the invention, each end of the extended nip roll is supported in a first bearing housing, each end of the backup roll is supported in a second bearing housing, a plurality of tie bolts are passed through a respective bolt hole in each first bearing housing into an aligning bolt hole in a respective second bearing housing, and the first end of each tie bolt is fixedly retain relative to the first and second bearing housings. Lastly, the second end of each tie bolt is stretched by forcing the second end in a direction opposite to the first end, e.g., when the extended nip roll and backup roll are not rotating, to pre-tighten the tie bolts. The stretching step may entail arranging a press part freely movable around each tie bolt, threadably connecting a backup part to the second end of each tie bolt, and pressurizing an annular groove defined in an upper face of each press part between the press part and an annular shoulder of a respective backup part to force the backup part and thus the second end of the tie bolt in a direction opposite to the first end of the tie bolt. More particularly, the pressurizing step may comprise directing a pressurized medium through a fluid duct connected to the press part into the annular shoulder and then into the annular groove. It is also preferable to lock the second end of the tie bolt in the stretched position. Other possible additions include the arrangement of the tie bolts symmetrically in relation to a nip plane defined by the plane passing through a central axis of the backup roll and a central axis of the extended-nip roll and the securing of a nut to the first end of each tie bolt to fixedly retain the first end of each tie bolt relative to the second end of each tie bolt.

In the following, the invention will be described with reference to some preferred exemplifying embodiments of the invention illustrated in the figures in the accompanying drawings. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which:

FIGS. 5A, 5B and 5C illustrate the operation of the tightening device used in the construction in accordance with the invention wherein FIG. 5A shows the stage before locking of the tightening, FIG. 5B shows the situation after the introduction of the fluid pressure, and FIG. 5C illustrates the locking of the construction in the pre-tightened state;

FIG. 6B is an exploded perspective illustration in part of a rotatable intermediate piece used in the lower roll construction.

DETAILED DESCRIPTION OF THE PREFERRED EMBODIMENTS

Figure 1A:
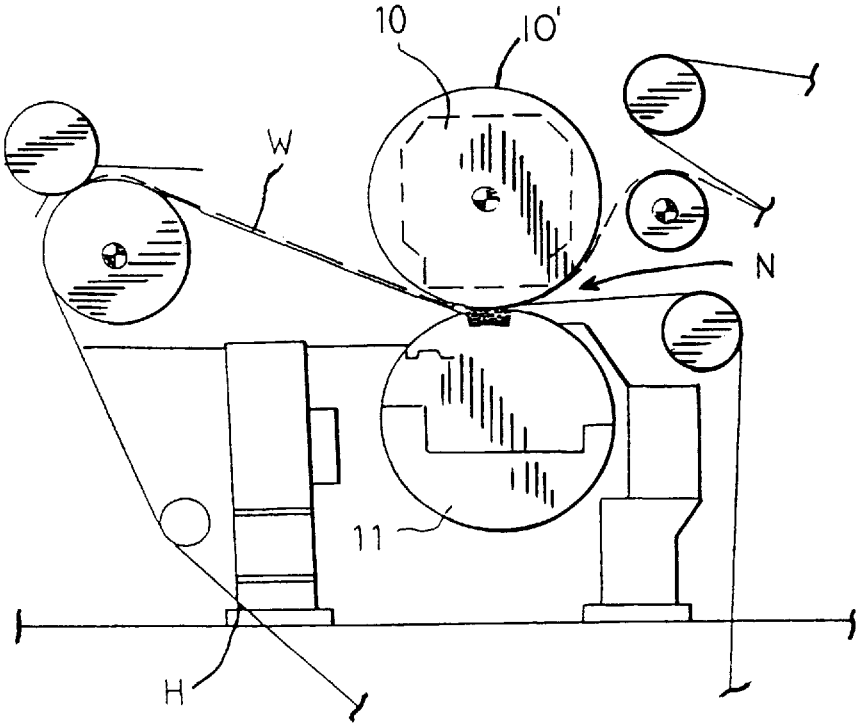
FIG. 1A PRIOR ART
FIG. 1A is an illustration in principle of an extended-nip press.

Referring to the accompanying drawings wherein the same reference numerals refer to the same or similar elements, FIG. 1A shows an extended-nip press equipment commonly used in a conventional paper machine. In the press equipment shown in FIG. 1A, a fibrous web W is passed into an extended nip N, formed between a lower extended-nip press roll 11 and a backup roll 10, while being supported between a felt H and a roll face 10' of the backup roll 10. The backup roll 10 is usually heated by appropriate heating means.

Figure 1B:
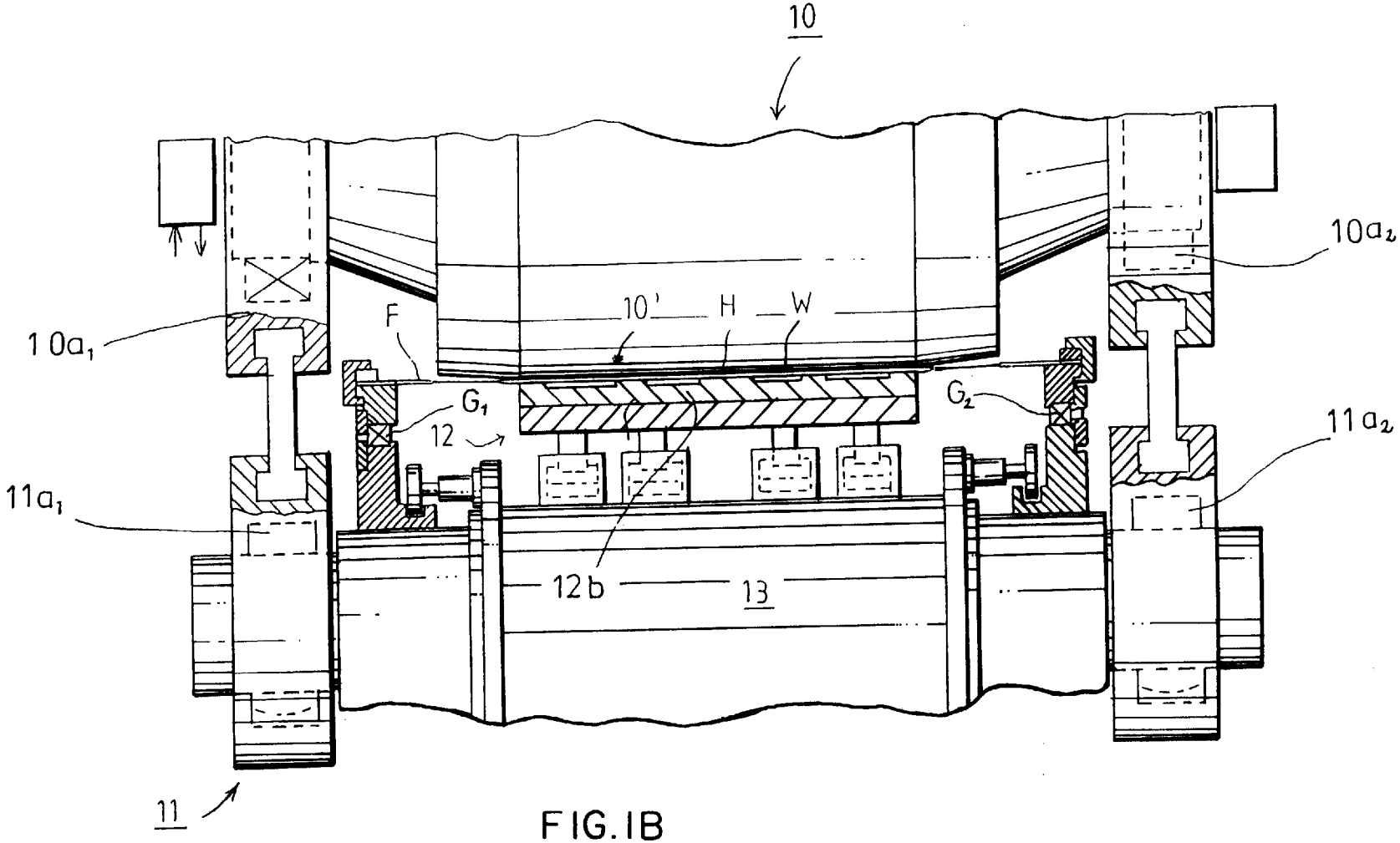
FIG. 1B PRIOR ART
FIG. 1B illustrates the principle of the construction of a prior art extended-nip roll.

FIG. 1B shows the rolls 10 and 11 of FIG. 1A viewed in the machine direction. The extended nip between the rolls 10 and 11 is denoted with the reference arrow N in FIG. 1B. The felt H and the web W are passed through the nip N. The roll 10 is a heated backup roll, and the roll 11 is an extended-nip press roll provided with loading means 12 extending in the axial direction of the roll 10. The loading means 12, preferably cylinder means $\mathbf{12}a_1$,$\mathbf{12}a_2$, . . . mounted on a central axle 13, are arranged to act with a force upon a loading or glide shoe 12*b* and further, through a flexible, closed glide belt mantle F, upon the web W so as to dewater the web by pressing. The web W may be a paper or board web. The lower extended-nip press roll 11 comprises a flexible closed glide belt mantle F which is guided to run along the face of the loading shoe or glide shoe 12*b*, whereby an oil medium is passed into the space between the glide shoe 12*b* and the closed glide belt mantle F as a lubricating medium. The backup roll 10 is preferably a roll heated by means of an inside heating medium, such as water, steam or oil, or from outside, e.g., by means of induction or infrared radiation. The backup roll 10 can also be a unheated roll. The belt mantle F revolves on support of bearing means $G_1$,$G_2$, and the central axle 13 is supported on bearing means $\mathbf{11}a_1$, and $\mathbf{11}a_2$, which permit angular bending or deflection of the non-revolving axle 13. The backup roll 10 comprises bearing means $\mathbf{10}a_2$,$\mathbf{10}a_2$ at a respective end of thereof. The bearing means $\mathbf{10}a_1$,$\mathbf{10}a_2$ of the backup roll are rigidly connected to a respective one of the bearing means $\mathbf{11}a_1$, $\mathbf{11}a_2$ of the extended nip roll 11.

Figure 2:
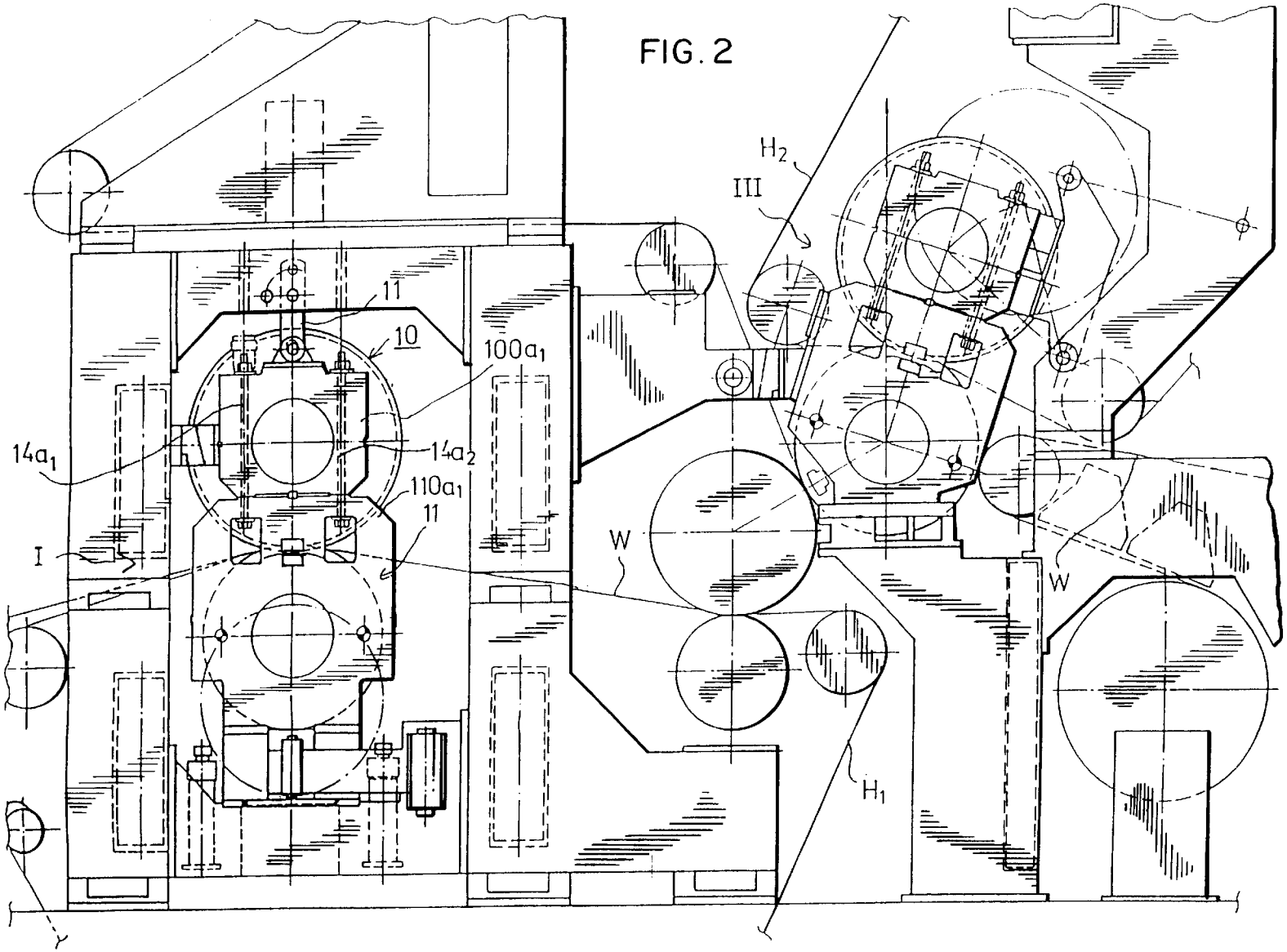
FIG. 2 illustrates a press section concept, which includes a coupling in accordance with the present invention between bearing housings.

FIG. 2 shows an extended-nip press interconnection arrangement in accordance with the invention, in which, between the bearing housing $\mathbf{110}a_1$ at one end of the extended-nip roll 11 and the bearing housing $\mathbf{100}a_1$ at the respective aligned end of its backup roll 10, in accordance with the invention, tie bolts $\mathbf{14}a_1$, $\mathbf{14}a_2$, i.e., so-called studs, are used as the tie parts to link the respective bearing housings together. The construction is similar in FIG. 2 both in connection with the press No. I and with the press No. III. In FIG. 2, the run of the web W is illustrated by dashed lines and the run of the felts $H_1$,$H_2$ by solid lines.

Figure 3A:
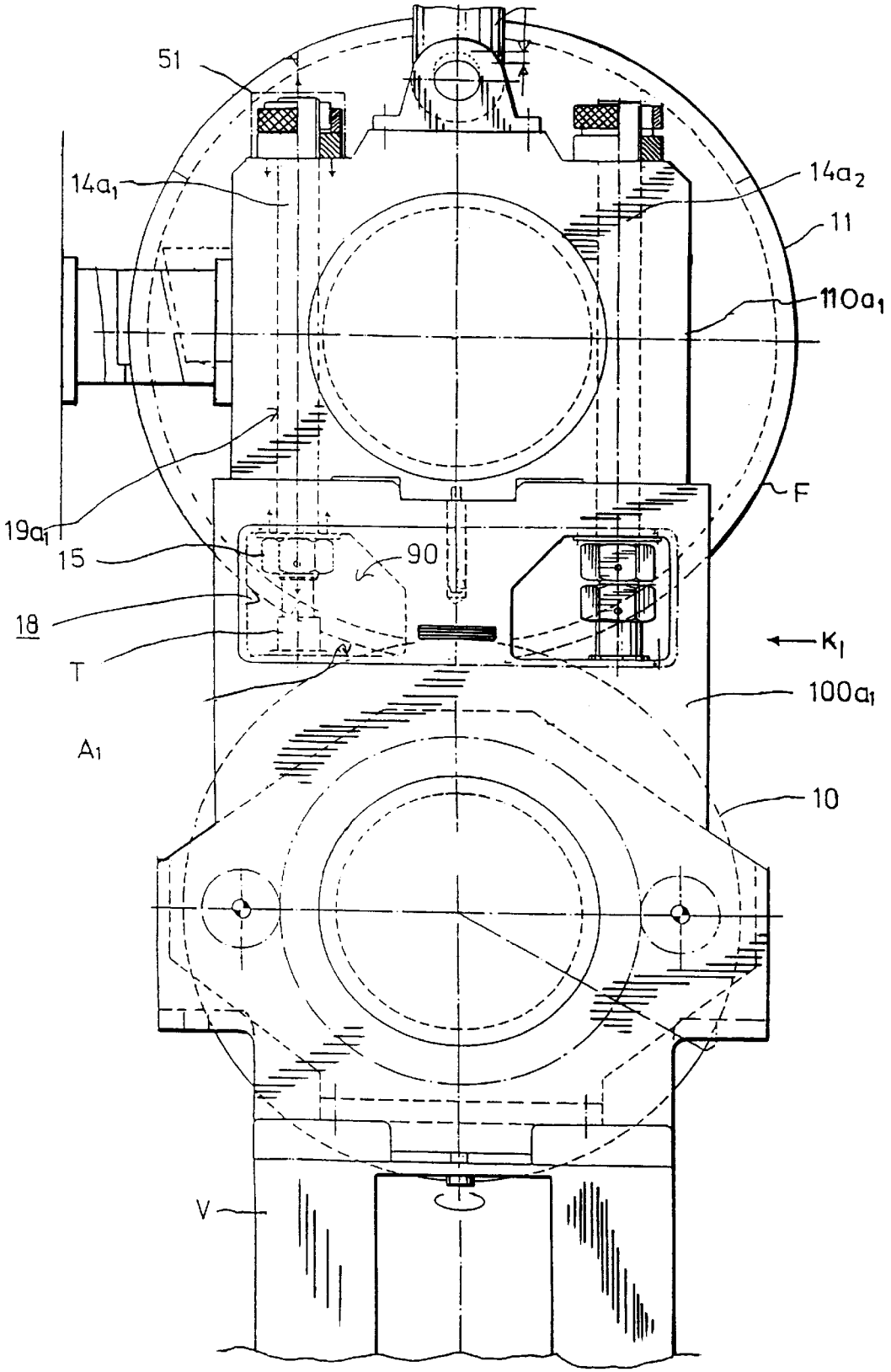
FIG. 3A is a side view of a coupling construction in accordance with the invention between an extended-nip roll and its backup roll.

FIG. 3A shows the coupling construction in accordance with the invention between the extended-nip roll 11 and its backup roll 10 in greater detail. The extended-nip roll 11 comprises bearing means $\mathbf{11}a_1$ and $\mathbf{11}a_2$ at the respective end of the roll, and similarly the backup roll 10 of the extended-nip roll comprises bearing means $\mathbf{10}a_1$, $\mathbf{10}a_2$ at the respective end of the roll 10. The bearing means $\mathbf{11}a_1$, $\mathbf{11}a_2$ comprise bearing housings $\mathbf{110}a_1$, $\mathbf{110}a_2$, respectively, and the bearing means $\mathbf{10}a_1$,$\mathbf{10}a_2$ comprise bearing housings $\mathbf{100}a_1$,$\mathbf{100}a_2$, respectively.

In accordance with the invention, the aligned bearing housings $\mathbf{100}a_1$ and $\mathbf{110}a_1$ at one end of the rolls 10,11, as well as the aligned bearing housings $\mathbf{100}a_2$ and $\mathbf{110}a_2$ at the other end of the rolls 10,11, are each interconnected by a plurality of tie bolts $\mathbf{14}a_1$, $\mathbf{14}a_2$ . . . The tie bolts $\mathbf{14}a_1$, $\mathbf{14}a_2$ . . . are made of steel, and their breaking strength values are very high. In such a case, the tie bolts can also be pre-tightened to very high values. According to the invention, such a tie bolt construction is used that one end of the tie bolt 14 is threaded and connected with a tightening nut 15 (i.e., a threaded connection) and a washer 16 and with locking means for locking the nut 15 in a fixed position in connection with the tie bolt 14 such as a locking pin 17 engaging with the tie bolt 14 and nut 15, and the opposite end of the construction is connected with a pre-tightening equipment 20 of the bolt 14.

Figure 3B:
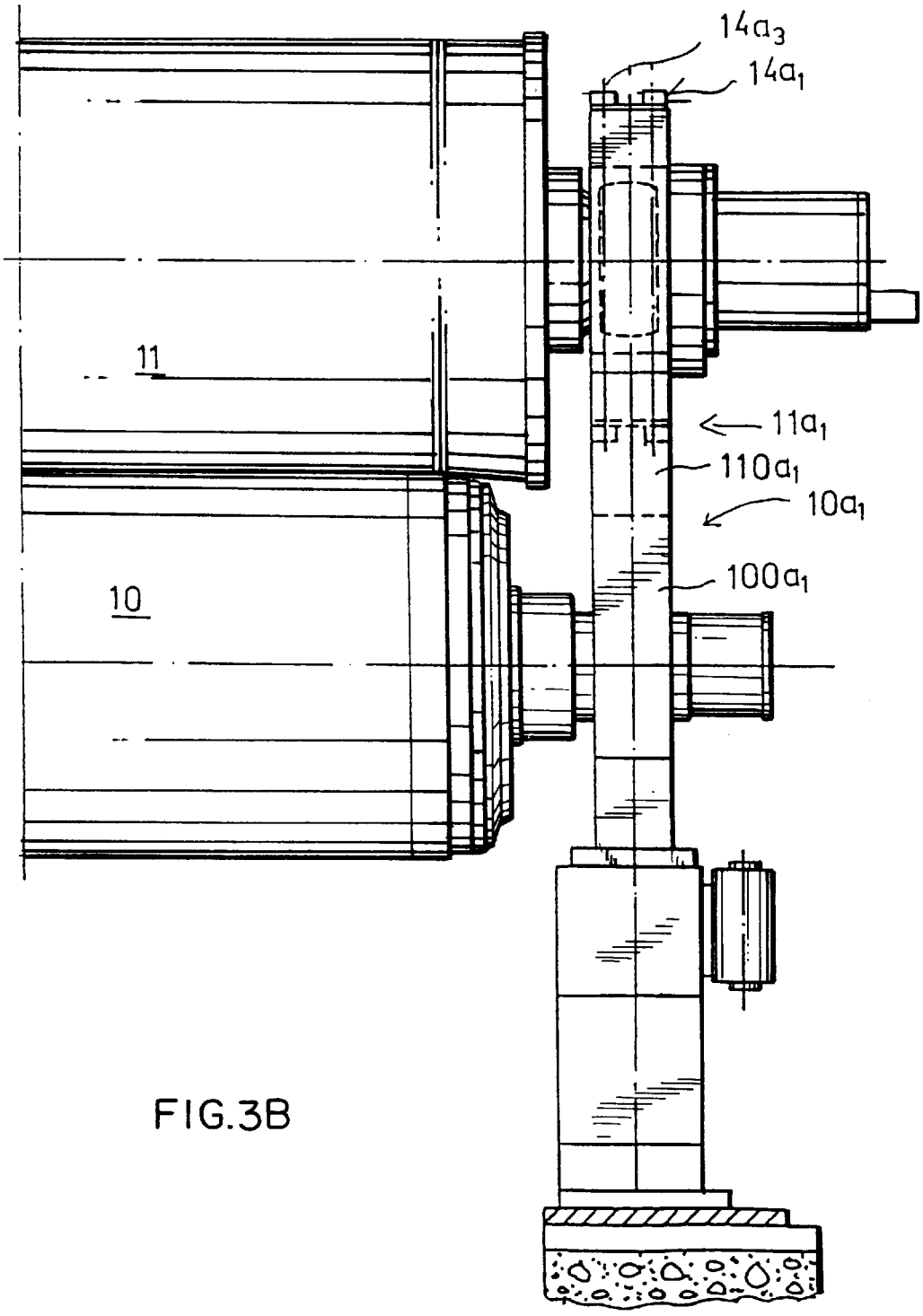
FIG. 3B shows the construction shown in FIG. 3A seen in the direction of the arrow K1 in FIG. 3A and as an illustration in part of the area of the ends of the rolls in the extended-nip press.

FIG. 3B shows the construction of FIG. 3A viewed in the machine direction and in the area of the roll ends. At both ends of the rolls, at both sides of the bearing housing constructions at the roll ends (symmetrically in relation to the loading plane of the bearing construction), there are two tie bolts, i.e., studs $\mathbf{14}a_1$, $\mathbf{14}a_2$,$\mathbf{14}a_3$,$\mathbf{14}a_4$. Thus, at each end of the construction, there are a total of four tie bolts or studs, and the total number of bolts (in the entire illustrated roll construction) is eight, $\mathbf{14}a_1$, . . . , $\mathbf{14}a_8$.

Figure 4:
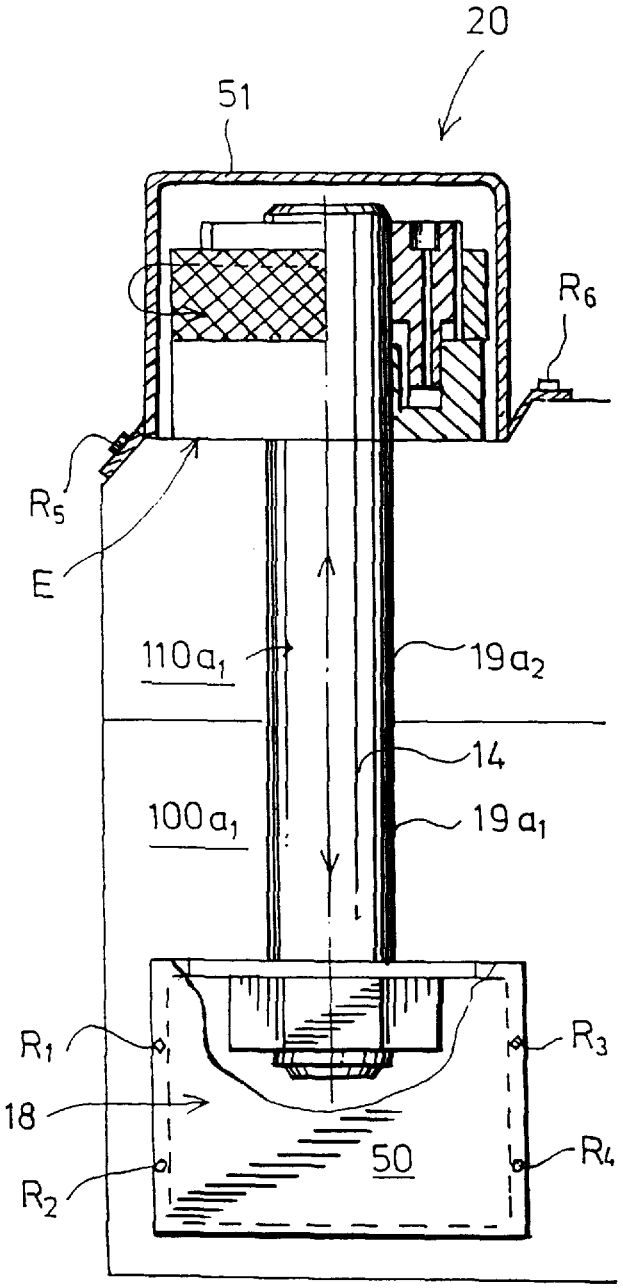
FIG. 4 shows a coupling construction in accordance with the invention between bearing housings as an axonometric view and as an illustration in part.

FIG. 4 shows a coupling construction in accordance with the invention between bearing housings with shield covers and hoods 50,51. The shield covers 50 and shield hoods 51 are attached to the bearing housings detachably by means of screws $R_1$,$R_2$ . . . or other comparable fastening means. The tie bolt 14 is arranged between the bearing housings $\mathbf{100}a_1$ and $\mathbf{100}a_1$ so that the tie bolt passes from a cavity 18 in the lower bearing housing $\mathbf{100}a_1$, and open toward the side for access, through a bolt hole $\mathbf{19}a_1$ extending from the cavity 18 to an upper surface of the lower bearing housing $\mathbf{100}a_1$ into another bolt hole $\mathbf{19}a_2$ in the upper bearing housing $\mathbf{110}a_1$ aligning with the bolt hole $\mathbf{19}a_1$ and extending to an upper or top face E of the upper bearing housing $\mathbf{110}a_1$. On the top face E of the upper bearing housing, the tie bolt 14 tightening equipment 20 is placed, which will be described in relation to FIGS. 5A–5C.

As shown FIG. 4, the cavity 18, which is accessible and open at one side only, includes a detachable cover 50, which can be locked, for example, by means of screws $R_1$,$R_2$ to cover the cavity 18. Then the cavity 18 is a fully closed space, and access of substances that produce corrosion into connection with the tie bolt 14 is excluded and prevented. The prevention of access of corrosive substances into the cavity 18 is also aided by the fact that, in the manner shown in FIG. 4, the bolt pre-tightening equipment 20 is also provided with a detachable shield hood 51 which covers the pre-tightening equipment 20. The fastening of the shield hood 51 can take place after pre-tightening of the bolts $\mathbf{14}a_1$,$\mathbf{14}a_2$ . . . , for example, by screw means $R_5$,$R_6$. Moreover, both the cover 50 and the shield hood 51 can be provided with locks in order to prevent undesirable removal of the cover/hood. Into each cavity 18, the bolt holes $\mathbf{19}a_1$ for two bolts $\mathbf{14}a_1$,$\mathbf{14}a_3$, $\mathbf{14}a_2$,$\mathbf{14}a_4$ are opened.

Figures 5A, 5B, 5C:
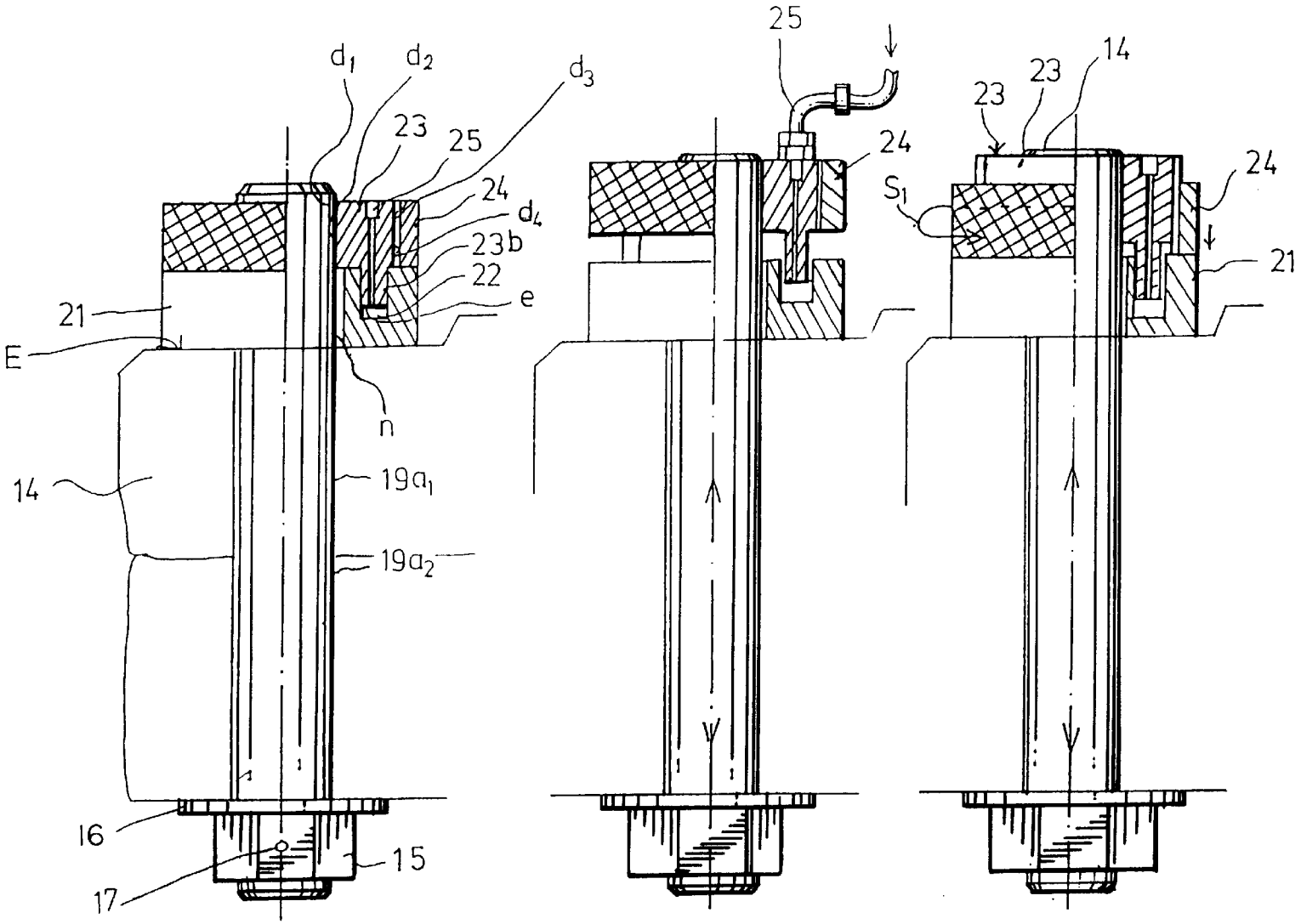

FIG. 5A shows a situation in which the fluid pressure is passed into a duct 25 through a backup part 23 and further into an annular fluid space 22 in a press part 21. As such, the pre-tightening equipment 20 comprises the press part 21 which defines the annular fluid space 22 in an interior thereof, and an annular shoulder 23*b* provided on the backup part 23 and extending into the annular fluid space 22. The backup part 23 is threaded onto a threading $d_2$ on the end of the tie bolt 14. The backup part 23 has a circular circumference including a threading $d_3$ onto which a lock ring 24 has been threaded by means of its threading $d_4$. The fluid duct 25 is provided to enable passage of a pressurized medium such as an oil medium through the backup part 23 and more particularly, through a fluid passage that leads from the top face 23' of the backup part 23, i.e., backup ring, to the end e of the annular shoulder 23*b*. Further, the annular shoulder 23*b* can be arranged to extend into the annular fluid space 22 placed in the press part 21, which fluid space 22 consists of an annular groove.

As shown in FIG. 5B, when the fluid pressure acts upon the fluid space 22, the tie bolt 14 is affected by the pulling force in a direction opposite to the other end of the tie bolt 14, in which connection the tie bolt 14 stretches while the press part 21 is placed freely around the tie bolt 14 against the top face E of the bearing housing. The press part 21 includes a central hole n, and so does the backup part 23. The backup part 23 is threaded by means of its inside threading $d_2$ onto the threading $d_1$ on the end of the tie bolt 14. Around the backup part 23, there is a lock ring 24, which is, after the stage shown in FIG. 5B, in the manner shown in FIG. 5C, threaded against the press part 21 (as is indicated by the arrow $S_1$ in the figure). In this manner, the pre-tightened state can be locked on the bolt 14. In the constructions, the lower nut 15 can be locked by means of a separate lock pin 17 on the opposite end of the tie bolt 14, i.e., stud, before the tightening equipment 20 is operated. A washer 16, is placed between the nut 15 and the bearing housing.

When the construction is disassembled, first the pre-tightening of the tie bolt is removed, and after this the lower nut is lowered, e.g., onto a mandrel T, which can be placed at the end of the tie bolt 14 on the lower face $A_1$ of the cavity 18 (FIG. 3A).

Figure 6A:
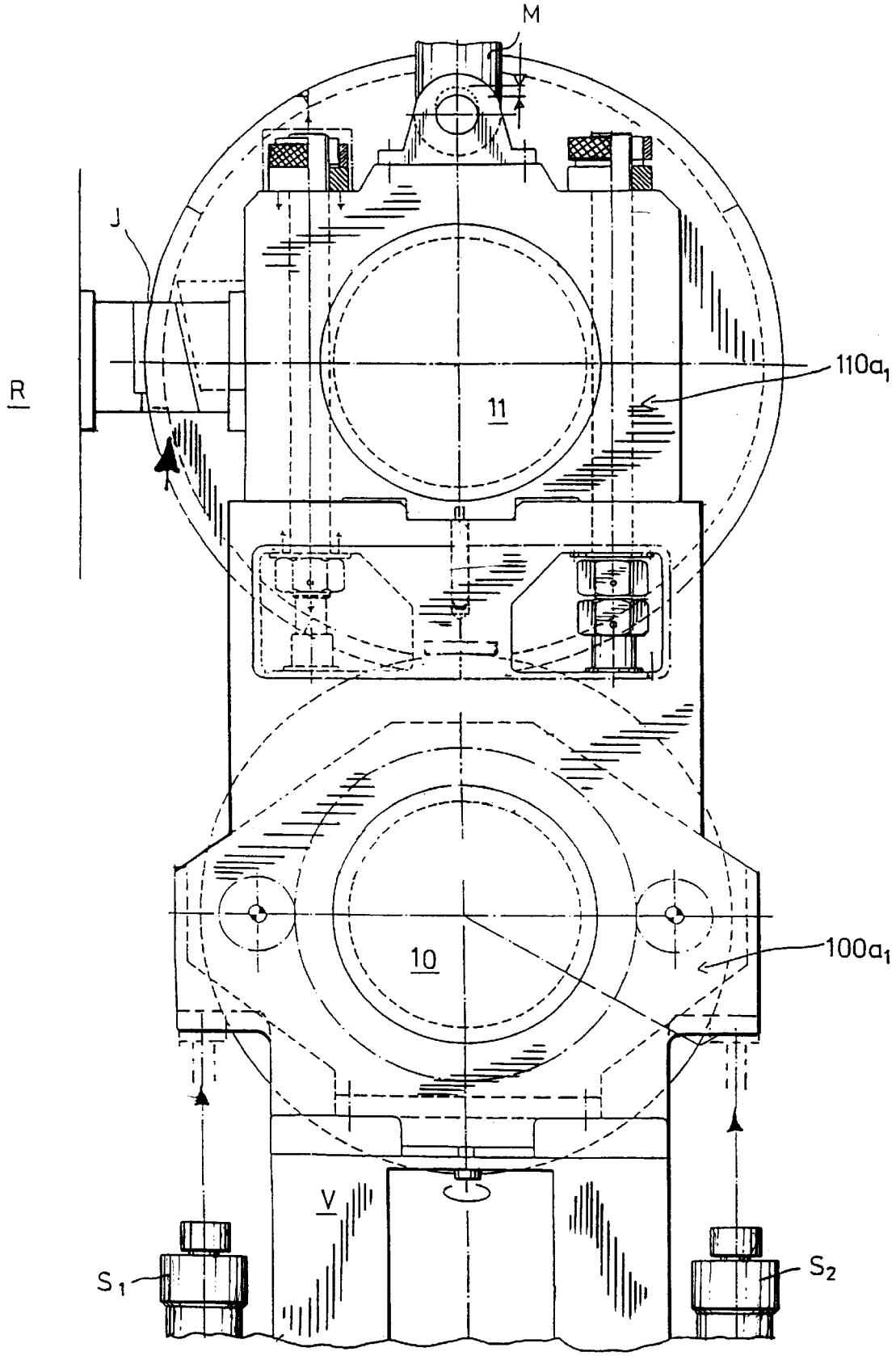
FIG. 6A illustrates the disassembly of the construction in accordance with the invention, for example, for replacement/conditioning of the belt mantle.

FIG. 6A shows and illustrates the disassembly of the construction in accordance with the invention, for example, for replacement/conditioning of the belt mantle F of the extended-nip roll 11. By means of an upper lifting gear M, after removal of the pre-tightening of the tie bolts $\mathbf{14}a_1$,$\mathbf{14}a_2$ . . . and after removal of the nuts 15 of the bolts $\mathbf{14}a_1$,$\mathbf{14}a_2$, the upper extended-nip roll 11 is lifted apart from the lower backup roll 10. When the coupling is disassembled and when the upper roll 11 is raised, a wedge spacer piece J placed at the side face of the bearing housing $\mathbf{110}a_1$ of the upper roll 11 is removed. The lower roll 10 is lowered to the lower position by using cylinders $S_1$ and $S_2$ placed in a fixed, invariable position and by acting, for example, upon the lower bearing housing $\mathbf{100}a_1$ of the roll 10, after which an intermediate piece V supported by an articulation screw 60 can be rotated through 90°, and after this the whole lower-roll construction can be lowered to the lower position.

FIG. 6B illustrates the U-section intermediate piece V resting on the rotating articulated joint 60. The lower bearing housing $\mathbf{100}a_1$ is mounted on the machine frame R by means of bolts (not shown). The intermediate piece V is placed between the machine frame R and the bearing housing $\mathbf{100}a_1$.

The examples provided above are not meant to be exclusive. Many other variations of the present invention would be obvious to those skilled in the art, and are contemplated to be within the scope of the appended claims.

I claim:

1. In a coupling construction for connecting an extended-nip roll and a backup roll, the extended-nip roll including a non-revolving central axle supported at each end by a first bearing housing, at least one loading shoe, loading means mounted on the non-revolving axle for pressing the at least one loading shoe toward the backup roll, and a flexible glide-belt mantle revolving about the at least one loading shoe, the backup roll being supported at each end by a second bearing housing, said first bearing housings supporting the extended-nip roll being connected by connecting means to respective ones of said second bearing housings supporting the backup roll, the improvement comprising each of said first bearing housings having a plurality of bolt holes, each of said second bearing housings having a plurality of bolt holes, each of said bolt holes in said second bearing housings aligning with a respective one of said bolt holes in said first bearing housings, and said connecting means comprising a plurality of elongate tie bolts, each of said tie bolts having first and second threaded ends and extending through one of said bolt holes in said first bearing housings and the respective aligned one of said bolt holes in said second bearing housings, a nut threaded onto said first threaded end of each of said tie bolts for fixing said first threaded end of said tie bolt relative to said first and second bearing housings, and pre-tightening means arranged in connection with said second threaded end of each of said tie bolts for stretching said tie bolt.

2. The coupling construction of claim 1, wherein said first threaded end of each of said said tie bolts extends within one of said first bearing housing such that a respective one of said nuts fixes said tie bolt to said first bearing housing.

3. The coupling construction of claim 1, wherein said first bearing housings define cavities, said bolt holes in said first bearing housings extending to one of said cavities, said first threaded end of each of said tie bolts extending into one of said cavities in one of said first bearing housings such that a respective one of said nuts fixes said tie bolt to said first bearing housing.

4. The coupling construction of claim 1, wherein said bolt holes in said second bearing housings extend from a first face of said second bearing housings adjacent the respective one of said first bearing housings to a second face opposite to said first face, said second threaded end of said tie bolts extending beyond said second face such that said pre-tightening means are arranged in connection with said second face.

5. The coupling construction of claim 1, wherein said pre-tightening means comprise a press part freely movable around said tie bolt, said press part having an upper face and an annular groove opening from said upper face, a backup part threadably connected to said second threaded end of said tie bolt and having an annular shoulder engageable with said annular groove, and pressurizing means for pressurizing said annular groove to force said backup part and thus said second threaded end of said tie bolt in a direction away from said first threaded end of said tie bolt, said pressurizing means comprising a fluid duct connected to said press part for enabling passage of a pressurized fluid through said fluid duct into said annular shoulder and then into said annular groove.

6. The coupling construction of claim 5, wherein said bolt holes in said second bearing housings extend from a first face of said second bearing housings adjacent the respective one of said first bearing housings to a second face opposite to said first face, said second threaded end of said tie bolts extending beyond said second face such that said press part is in contact with said second face.

7. The coupling construction of claim 6, wherein said backup part has an outer threaded surface, further comprising locking means arranged in connection with said outer threaded surface of said backup part for locking said press part after pressurization of said annular groove to thereby lock said tie bolt in a pre-tightened condition.

8. The coupling construction of claim 7, wherein said locking means comprise a lock ring which is threaded after pre-tightening of said tie bolt against said upper face of said press part.

9. The coupling construction of claim 1, wherein each of said first bearing housings include an accessible cavity, said first end of said tie bolts being passed into a respective one of said cavities, said nuts threaded to said first threaded end of said tie bolts being situated in said cavities.

10. The coupling construction of claim 9, further comprising a plurality of mandrels situated in each of said cavities for receiving a respective one of said nuts when said nuts are not in engagement with the respective one of said tie bolts.

11. The coupling construction of claim 9, further comprising a detachable cover for covering each of said cavities.

12. The coupling construction of claim 1, further comprising a detachable shield hood for covering said pre-tightening means.

13. The coupling construction of claim 1, where said plurality of tie bolts comprise eight tie bolts, four of said tie bolts connecting each of said first bearing housings to the respective one of said second bearing housings.

14. The coupling construction of claim 13, wherein said tie bolts are symmetrically arranged relative to a nip plane defined by the plane passing through a central axis of said backup roll and a central axis of said extended-nip roll.

15. A method for coupling an extended-nip roll and a backup roll, comprising the steps of:

supporting each end of the extended nip roll in a first bearing housing, supporting each end of the backup roll in a second bearing housing, passing a plurality of tie bolts through a respective bolt hole in each of said first bearing housings into an aligning bolt hole in a respective one of said second bearing housings, each of said tie bolts having first and second threaded ends, fixedly retaining said first end of each of said tie bolts relative to said first and second bearing housings, and stretching said second end of each of said tie bolts by forcing said second end in a direction opposite to said first end to tighten said tie bolt.

16. The method of claim 15, wherein said stretching step comprises the steps of:

arranging a press part freely movable around each of said tie bolts, threadably connecting a backup part to said second end of each of said tie bolts, and pressurizing an annular groove defined in an upper face of each of said press parts between said press part and an annular shoulder of a respective one of said backup parts to force said backup part and thus said second end of said tie bolt in a direction opposite to said first end of said tie bolt.

17. The method of claim 16, wherein the pressurizing step comprises the step of directing a pressurized medium through a fluid duct connected to said press part into said annular shoulder and then into said annular groove.

18. The method of claim 15, further comprising the step of locking said second end of said tie bolt in the stretched position.

19. The method of claim 15, further comprising the step of arranging said tie bolts symmetrically in relation to a nip plane defined by the plane passing through a central axis of said backup roll and a central axis of said extended-nip roll.

20. The method of claim 15, wherein the step of fixedly retaining said first end of each of said tie bolts comprises the step of securing a nut to said first end of each of said tie bolts.

* * * * *